United States Patent [19]

Moran

[11] Patent Number: 4,828,625

[45] Date of Patent: May 9, 1989

[54] APPARATUS AND METHOD FOR REMOVAL OF SLUDGE FROM TANKS

[75] Inventor: James J. Moran, Sugar Land, Tex.

[73] Assignee: Nalco Chemical Company, Sugar Land, Tex.

[21] Appl. No.: 23,206

[22] Filed: Mar. 9, 1987

[51] Int. Cl.[4] ..... B08B 9/00

[52] U.S. Cl. ..... 134/22.18; 134/25.1; 134/25.4; 134/39; 134/40; 134/168 R; 134/169 R; 134/172; 134/175; 134/200; 134/201; 210/767; 210/535

[58] Field of Search ..... 15/318, 316 A, 316 R; 122/392; 210/500, 535, 515, 767, 220; 134/25.1, 25.4, 22.1, 22.11, 22.12, 22.19, 22.14, 10, 40, 39, 24, 12.18, 172, 175, 177, 200, 201, 168 R, 169 R; 33/32.6; 261/754

[56] References Cited

U.S. PATENT DOCUMENTS 3,407,099 10/1968 Schnell ..... 148/153
3,895,756 7/1975 Jaeger ..... 134/167 R
4,201,597 5/1980 Armstrong et al. ..... 134/167 R
4,244,523 1/1981 Looper ..... 134/167 R
4,364,776 12/1982 McBride et al. ..... 134/168

OTHER PUBLICATIONS

Refinery Services International Process for Cleaning Storage Tanks.

*Primary Examiner*—H. M. S. Sneed
*Assistant Examiner*—Sharon T. Cohen
*Attorney, Agent, or Firm*—Dodge, Bush & Moseley

[57] ABSTRACT

Apparatus and method for removal of sludge (26) from a tank (10) having a floating roof (16) floating on the upper surface of oil within the tank (10). Discharge nozzles (58) are received within existing sleeves (22) on the floating roof (16) and positioned adjacent the upper surface of the sludge (26) for the recirculation of the contents of tank (10) directly into the sludge (26) from a position above the sludge (26). A recirculation pump (30) provides pressurized fluid to a manifold (48) on roof (16) for distribution through flexible lines (54) to the discharge nozzles (58).

10 Claims, 3 Drawing Sheets

APPARATUS AND METHOD FOR REMOVAL OF SLUDGE FROM TANKS

BACKGROUND OF THE INVENTION

This invention relates to an apparatus and method for removal of sludge from tanks and more particularly to such an apparatus and method which utilizes a floating roof or cover in the tank over the liquid in which the sludge is formed.

Heretofore, such as shown in U.S. Pat. No. 4,364,776, dated Dec. 21, 1982, various methods or processes have been utilized for the removal of a body of sludge formed in storage tanks for crude or partly refined oil. Such methods have included the circulation of solvents to dissolve or disperse the sludge within the oil, but such methods have normally recirculated the lighter sludge fraction and dispersed chemicals from positions adjacent the sides of the tanks generally in a swirling action. By recirculation from the side of the tank, only a relatively small portion of the total fluid volume within the relatively large tank is recirculated and oftentimes, the main body of sludge is located at or adjacent the center of the tank and not the side of the tank. Such recirculation methods and systems heretofore have not utilized the mixing energy efficiently since a major energy output is utilized in obtaining a relatively high flow velocity adjacent the side of the tank, but not employed in circulating the contents of the tank to any extent adjacent the center portion of the tank. Thus, previous methods and apparatus have required relatively large periods of time for the dispersal and removal of the sludge from an associated tank, such as a week for example, during which the fluids were circulated continuously for twenty-four (24) hours each day.

The aforesaid U.S. Pat. No. 4,364,776 attempted to solve this problem of the recirculating fluid reaching the main body of sludge by utilizing lances inserted within the sludge from the side of the tank. However, it is noted that oil tanks containing sludge have a diameter from around fifty (50) feet to around three hundred (300) feet and it is difficult to utilize lances effectively from the side of the tank, particularly when large diameter tanks such as two hundred (200) feet or more in diameter are involved. Further, when only one lance for each pump is provided, only a relatively small portion of the sludge is reached by the recirculating liquid and thus requires considerable time in which to disperse the sludge.

SUMMARY OF THE INVENTION

The present invention is directed to an apparatus and method for removal of sludge from a tank by utilizing a floating roof or cover floating on the upper surface of the liquid within the tank and located over the sludge. The recirculating fluid including any dispersal chemicals is discharged from generally vertically extending discharge lines received within previously existing spaced sleeves fixed to the roof with the discharge lines having discharge nozzles on their lower ends positioned adjacent or within the main body of sludge to be removed. The number of discharge nozzles and the precise location of such discharge nozzles relative to the main sludge body may be predetermined thereby to provide a highly effective system for the removal of sludge in a minimum of time.

The sludge removal system of this invention utilizes previously existing sleeves or tubular members secured to the floating roof at predetermined locations and having support legs removably secured thereto for supporting the roof a minimum height from the bottom of the tank upon the emptying of the tank. The preexisting sleeves are positioned directly above the sludge and suitable probes or the like may be employed in addition to visual inspection for determining the exact contour and location of the sludge deposits. Then, the sludge removal system can be patterned or predesigned for a predetermined location of a predetermined number of discharge nozzles for effecting the removal of sludge in a minimum of time.

In carrying out this invention, the legs associated with the sleeves selected for receiving the discharge nozzles are first removed and then discharge lines including the nozzles are inserted within the sleeves. A manifold located on the floating roof may have connections for around ten (10) discharge lines, for example, and thus ten (10) different locations in the sludge may be reached by the discharge nozzles for each manifold. A recirculating pump is normally associated with each manifold and several manifolds with associated pumps may be employed as desired. The present system thus utilizes the mixing energy efficiently by circulating the tank contents and discharging directly into the main body of sludge from locations above the sludge.

It is an object of the present invention to provide an apparatus and method for the removal of sludge from a tank in a minimum of time.

It is a further object of the invention to provide such an apparatus and method in which a floating roof within the tank has a plurality of preexisting spaced sleeves thereon which are utilized to receive discharge nozzles for the discharge of liquid and dispersal chemicals into the sludge from predetermined locations on the roof above the sludge.

It is an additional object of the invention to provide such a system for sludge removal in which a manifold receiving pressurized fluid from a pump is supported on a floating roof in the tank and has a plurality of discharge lines leading therefrom to selected locations on the roof for the discharge of dispersal fluid into the sludge.

Other objects, features, and advantages of this invention will become more apparent after referring to the following specification and drawings.

FIG. 2 is a sectional view taken generally along line 2—2 of FIG. 1 and illustrating the apparatus in position on the floating roof within a tank for crude oil or the like;

Figure 3:
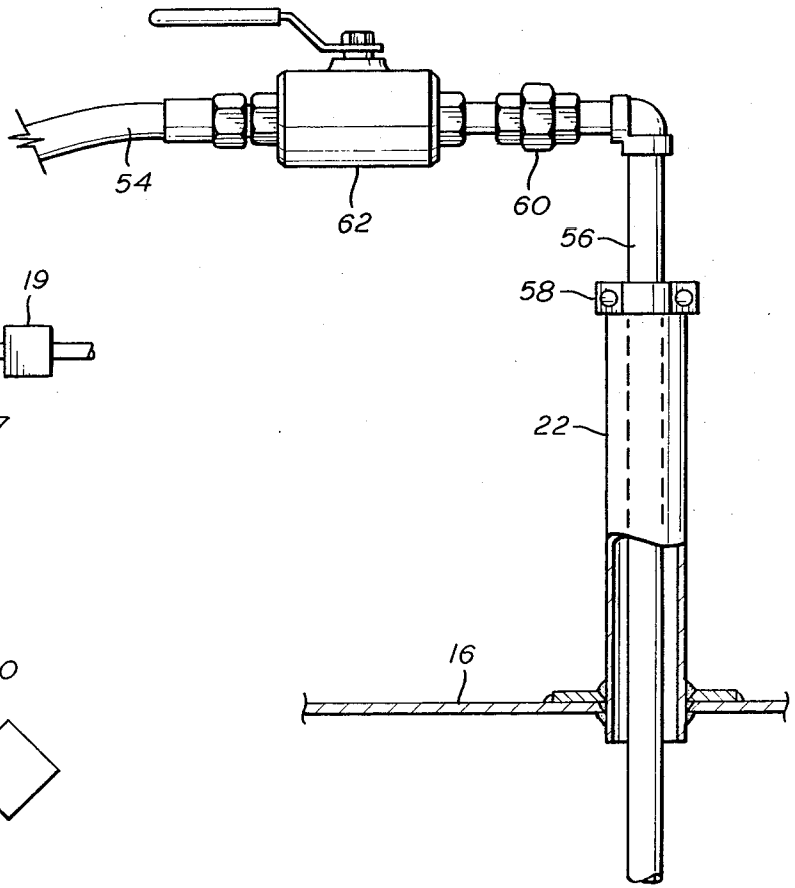
FIG. 3 is an enlarged elevation, partly in section, illustrating a vertically extending discharge line received within a preexisting sleeve secured to the floating roof.

Referring now to the drawings for a better understanding of this invention, a cylindrical tank is indicated generally at 10 and has an open top or upper end. Tank 10 is a storage tank for crude or partly refined oil and may be from around fifty (50) feet to three hundred (300) feet in diameter with a height of from around twenty (20) feet to one hundred (100) feet, for example. Tank 10 includes a circular or annular side 12 and a bottom 14. A floating roof or cover indicated generally at 16 floats on the upper surface of the oil within tank 10 and an outer flotation ring 18 provides buoyancy for floating roof 16 on the contents of tank 10. To remove the tank contents of tank 10 to another tank or for further processing, an outlet line 17 is provided along with a suitable pump 19.

Figure 1:
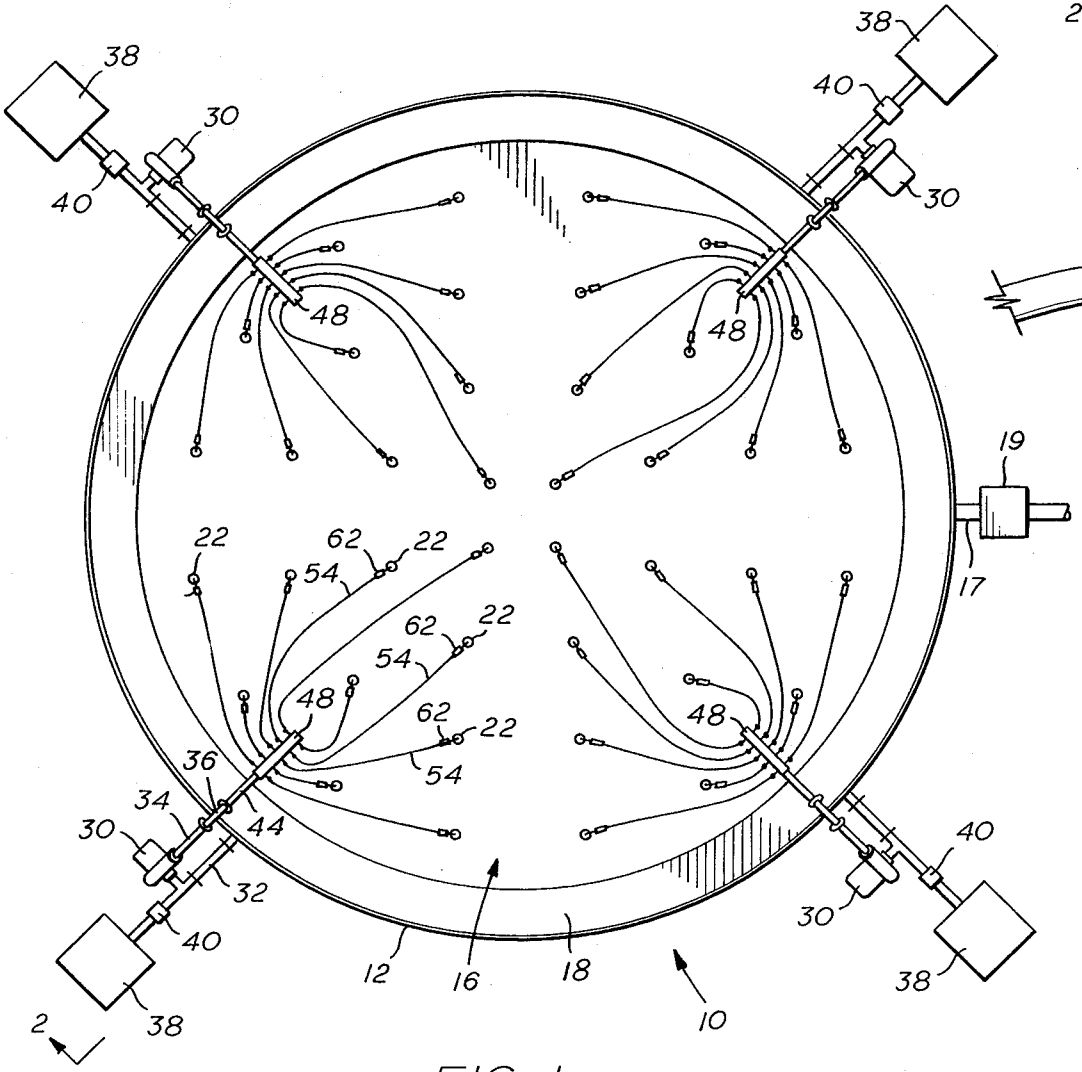
FIG. 1 is a top plan of the present invention utilized with a tank having a floating roof thereon.
Figure 2:
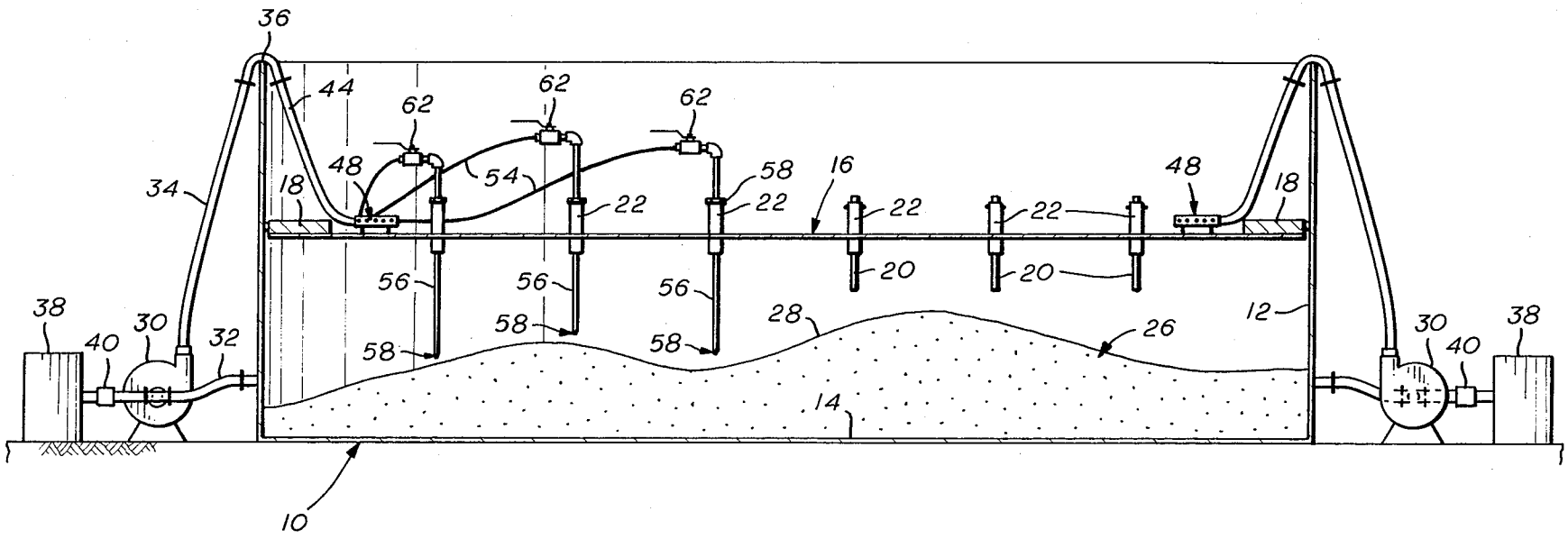
Figure 7:
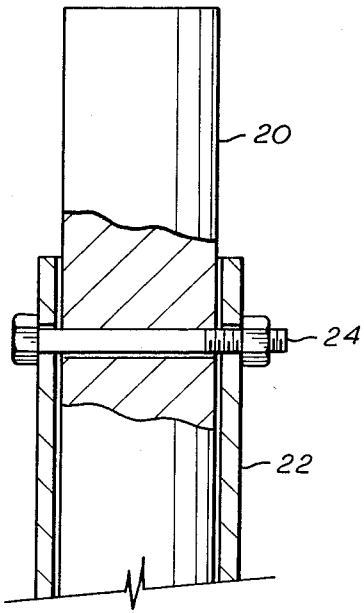
FIG. 7 is an enlarged section, partly in elevation, illustrating the connection of a support leg to a sleeve on the floating roof.

In order to support roof 16 in a spaced relation to bottom 14 of tank 10 when the contents of tank 10 are emptied, a plurality of vertical support legs 20 and associated tubular sleeves 22 are normally provided. Sleeves 22 are mounted within suitable openings through roof 16 and are welded to roof 16. As shown in FIG. 1, sleeves 22 are arranged in spaced relation along concentric circles and pin or bolt connections 24 extending through suitable openings in sleeves 22 and legs 20 removably hold legs 20 within sleeves 22. The present invention utilizes the preexisting sleeves 2 mounted on roof 16 to support suitable discharge nozzles in a predetermined location over the body of sludge shown generally at 26 and having an upper surface or profile shown at 28. It is apparent that the height of the sludge deposits within tank 10 will vary at different positions within tank 10 and that the heavier sludge fractions will normally be located adjacent bottom 14 of tank 10 while the lighter sludge fractions will normally be positioned on the upper portion of the sludge deposits or masses.

It is desirable to break down the sludge body physically and chemically so as to form a pumpable mass that can be drained from tank 10 for transport to other tanks or to the refining process as desired. Upper surface 28 of the sludge 26 may be determined by suitable access openings and associated covers (not shown) in roof 16 upon removal of the covers over such access openings. Probes as well as visual inspection and chemical analysis may be made of sludge samples which may be withdrawn thereby to determine the amount and type of chemicals desired as additives to the tank for assisting in breaking up the sludge mass or body. After a determination of the sludge profile 28 the number and location of sleeves 22 to be utilized with the present invention is predetermined in order to provide access to the major areas of sludge deposits.

A recirculating pump is shown at 30 and may be of a centrifugal type with a suction line 32 extending from adjacent the bottom of tank 10 to pump 30. An outlet line 34 for supplying pressurized circulated fluid from tank 10 extends from pump 30 and is connected to a transition section 36 extending over the upper end of tank 10. A suitable tank for chemicals may be utilized as shown at 38 and may be connected to pump P for supplying chemicals thereto for discharge within tank 10. A suitable valve 40 may be provided between pump 30 and tank 38.

Figure 4:
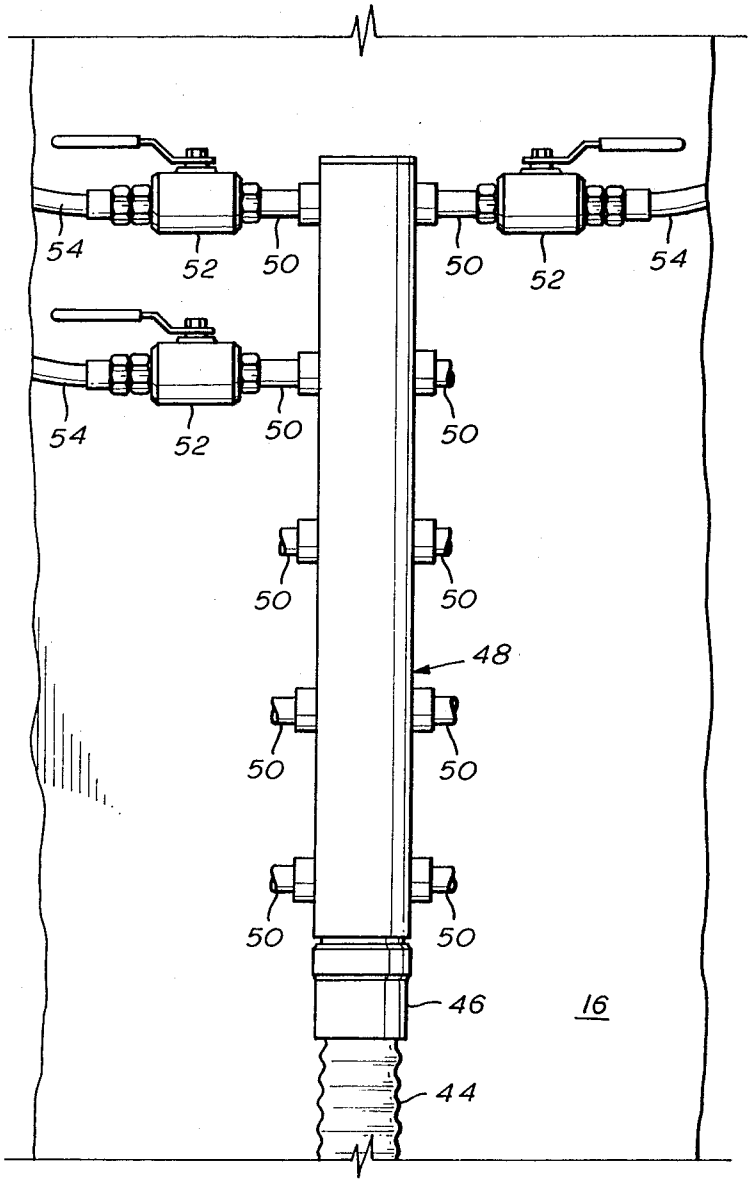
FIG. 4 is an enlarged plan of a manifold mounted on the floating roof and having a plurality of outlet lines extending therefrom for connection to the discharge lines for the nozzles.

A flexible line or hose 44 extends from transition section 36 to inlet end 46 of a manifold indicated generally at 48. As shown particularly in FIG. 4, manifold 48, which, for example, may be a pipe section of around six (6) inches in diameter, has a plurality of outlet pipes or lines 50 of around two (2) inches in diameter extending therefrom with two-way manually operated ball valves 52 therein to control the flow of fluid from manifold 48. Manifold 48 as shown in FIG. 4 has ten (10) outlet lines 50 connected thereto and may be designed for any desired number of outlet lines, such as between around four (4) to fifteen (15), for example. Outlet pipes 50 may be around two (2) inches in diameter. Flexible hoses 54 may be suitably connected to valves 52.

As shown in FIG. 1, four (4) independent systems are illustrated for tank 10 with one system for each quadrant of roof 16, each system including a pump 30 and a manifold 48. The desired number of pumps and associated manifolds may be determined by the size of the tank and the amount and type of sludge deposits within tank 10. Each independent system operates in a similar manner and for the purposes of illustration, only one system will be illustrated, it being understood that the remaining systems operate in a similar manner.

Based on a determination of sludge profile 28, ten (10) sleeves 22, for example, are selected for the supporting discharge nozzles over the sludge deposits. The ten (10) selected sleeves 22 first have the associated legs 20 removed therefrom by removal of the pin connection shown at 24. Suitable lengths of flexible hoses 54 are connected between outlets 50 and the desired associated sleeve 22. Next, a rigid discharge pipe 56 having at its lower end a discharge nozzle shown generally at 58 is positioned within sleeve 22 and lowered to the desired position at which nozzle 58 is closely adjacent or slightly within sludge 26. At the desired height, an adjustable clamp extending around pipe 56 is secured to pipe 56 in abutting relation to the upper end of sleeve 22 to position nozzle 58 at the predetermined height. Then, a removable coupling shown at 60 between a two-way manually operated ball valve 62 and pipe 56 is connected. Valve 62 is connected to flexible line 54 and controls the flow of fluid to associated discharge nozzle 58.

Figure 6:
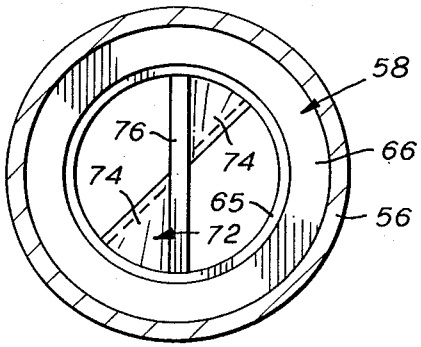
FIG. 6 is a section taken generally along line 6—6 of FIG. 5.
Figure 5:
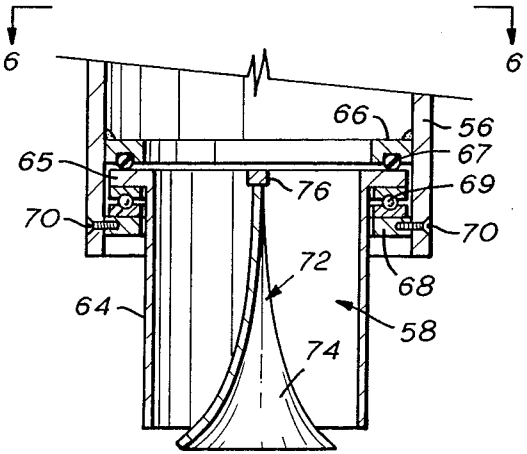
FIG. 5 is an enlarged sectional view of a discharge nozzle on the end of the discharge line and showing an eccentric discharge port therein for rotating the nozzle during use thereof.

As shown in FIGS. 5 and 6, discharge nozzle 58 has a generally cylindrical body 64 with an upper flange 65 positioned against an O-ring 67 within an inner bearing ring 66 secured within pipe 56. Suitable ball bearings 69 are provided between flange 65 and an outer bearing ring 68 which is secured by suitable screws 70 to pipe 56 upon insertion of bearings 69 and nozzle 58 within the open end of pipe 56. Nozzle 58 has an outwardly extending deflector vane or blade 72 positioned within body 64 forming concave surfaces 74 against which the discharged fluid strikes. The inner end of vane 72 has a support bar 76 secured to body 64 and upon fluid striking surfaces 74 discharge nozzle 58 rotates relative to pipe 56 thereby to assist in the breaking up of the sludge.

The remaining discharge pipes 56 and discharge nozzles 58 are likewise positioned in a similar manner with associated sleeves 22 at predetermined heights within tank 10. Upon connection of all of the desired lines 54 and pipes 56, recirculating pump 30 may be energized and valves 52 and 62 moved to open position to provide a continuous recirculation of fluid through nozzles 58, suction line 32, and pressure line 34.

As a specific but non-limiting example, tank 10 has a diameter of one hundred fifty (150) feet and has a recirculating pump 30 and associated manifold 48 for each quadrant of roof 16. Each manifold 48 has ten (10) outlet pipes thereon with manifold 48 having a diameter of around six (6) inches and the outlet lines being around two (2) inches in diameter. Pump 30 has a pressure of around sixty (60) psi and supplies one thousand (1000) gallons of fluid per minute (GPM) through line 34. This is adequate to provide a velocity of around eighteen (18) or twenty (20) feet per second while maintaining the pressure of around fifty-five (55) to sixty (60) psi. Utilizing such a system, a tank has been cleaned in around one (1) day or twenty-four (24) hours, whereas under the previous systems employed in which the fluid was recirculated by the discharge of fluid from the side of the tank, it has taken from three (3) days to a week for cleaning of a similar deposit of sludge. Thus, the circulation of the tank from predetermined locations above the sludge deposits has been found to be highly effective in the removal of sludge from a tank in a minimum of time.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A process for removing sludge settled on the bottom of a fixed tank in which a roof floats on the surface of a liquid above the settled sludge and has a plurality of vertically extending sleeves secured to the roof and extending therethrough to provide access to the interior of the tank beneath the roof; said process including the steps of:

providing a pump for the recirculation of the liquid with the tank including an inlet line extending from a side of the tank and a positive pressure outlet line extending to the roof within the tank;

positioning a plurality of discharge nozzles and associated discharge lilnes within selected associated sleeves with said discharge nozzles being supported from said sleeves in suspended relation and adjustable in height on said sleeves for positioning at a predetermined height relative to the upper surface of the sludge and said discharge lines being in fluid communication with said positive pressure outlet line;

recirculating the liquid from the bottom of the tank through the discharge lines for discharge from the discharge nozzles at a relativelly high velocity to churn and break up the sludge deposits on the bottom of the tank for discharge from the tank with the associated liquid thereby to minimize any settling of sludge on the bottom of the tank; and removing the contents of the tank for further processing.

2. A process for removing sludge settled on the bottom of a tank as set forth in claim 1 further including the step of providing a manifold between the outlet line from said pump and said discharge nozzles for distributing pressurized fluid from the outlet line to the discharge lines connected to the nozzles.

3. A process for removing sludge settled on the bottom of a fixed tank in which a roof floats on the surface of a liquid above the sludge and has a plurality of vertically extending support legs removably connected within associated sleeves secured to the roof and adapted to support the roof at a predetermined minimum height of the roof above the bottom of the tank; said process including the steps of:

providing a pump for the recirculation of the liquid within the tank including an inlet line extending from a side of the tank and a positive pressure outlet line extending to the roof within the tank;

removing at least one support leg from the associated sleeve;

positioning a discharge nozzle and associated discharge line within said associated sleeve with said discharge nozzle being supported from said sleeve in suspended relation and adjustable in height on said sleeve for positioning said nozzle below said sleeve at a predetermined height relative to the upper surgace of the sludge and said discharge line being in fluid communication with said positive pressure outlet line;

recirculating the liquid from the bottom of the tank through the discharge line for discharge from the discharge nozzle at a relatively high velocity to churn and break up the sludge deposits on the bottom of the tank for discharge from the tank with the associated liquid thereby to minimize any settling of sludge on the bottom of the tank; and removing the contents of the tank for further processing.

4. Apparatus for removing sludge deposits from the bottom of a fixed tank comprising:

a floating horizontally extending roof within the tank supported on the upper surface of the liquid within the tank with the sludge being positioned below the roof;

a plurality of sleeves positioned at predetermined horizontally spaced locations on the roof and extending through openings in the roof at said predetermined locations for providing access therethrough to the interior of the tank;

a discharge line having a discharge nozzle on the lower end positioned within and supported in suspended relation beneath the roof by an associated sleeve for vertical adjustment to a predetermined height relative to said sleeve for positioning the associated discharge nozzle relative to the upper surface of the sludge in the tank; and means for recirculating liquid from the bottom of the tank through the discharge line for discharge from the associated discharge nozzle at a relatively high velocity into the sludge to break up the sludge and thereby permit the sludge to be easily removed from the tank.

5. Apparatus as set forth in claim 4 wherein said means for recirculating liquid includes a pump, a suction inlet line to the pump receiving fluid from the tank, and an outlet pressure line from the pump extending over the upper end of the tank and in fluid communication with said discharge line for the discharge nozzle.

6. Apparatus as set forth in claim 5 wherein a manifold is positioned on the roof and is in fluid communication with said outlet line; and a plurality of outlet lines extend from the manifold to a plurality of predetermined sleeves extending from said roof, each of said outlet lines adapted to be connected to an associated discharge line and nozzle.

7. Apparatus for removing sludge deposits in situ from the bottom of a fixed cylindrical tank comprising:

a floating horizontal extending circular roof within the tank supported on the upper surface of the liquid within the tank with the sludge being positioned below the roof;

a pluralilty of sleeves positioned at predetermined horizontally spaced locations on the roof and extending through openings in the roof at said predetermined locations for providing access therethrough to the interior of the tank, said sleeves adapted to receive removable support legs therein for supporting the roof in a spaced relation to the bottom of the tank upon emptying of the tank;

a plurality of fluid discharge lines received within a plurality of predetermined sleeves with each discharge line having at the lower end an associated discharge nozzle suspended in supporting relation from an associated sleeve, means for positioning each discharge nozzle on the associated sleeve at a predetermined height relative to the upper surface of the sludge in the tank;

a fluid manifold supported on said roof and connected to said plurality of fluid discharge lines; and a recirculating pump providing fluid under pressure to said fluid manifold and receiving fluid from said tank.

8. Apparatus for removing sludge deposits from the bottom of a tank as set forth in claim 7 wherein a manually operated valve is positioned between the manifold and each of said discharge lines.

9. Apparatus for removing sludge deposits from the bottom of a tank as set forth in claim 7 wherein each of said discharge lines has an adjustable clamp thereon for abutting the upper end of the associated sleeve to adjust the height of the associated nozzle within the tank.

10. Apparatus for removing sludge deposits from the bottom of a tank as set forth in claim 9 wherein siad nozzle has an eccentrically located main discharge port therein; and means mount said nozzle for rotation relative to the associated discharge line whereby said nozzle rotates upon the discharge of fluid from said main discharge port.

* * * * *